US009458607B2

(12) United States Patent
Swope et al.

(10) Patent No.: US 9,458,607 B2
(45) Date of Patent: Oct. 4, 2016

(54) ROTATABLE CUTTING TOOL WITH HEAD PORTION HAVING ELONGATED PROJECTIONS

(75) Inventors: Chad Allen Swope, Bedford, PA (US); Seth Daniel Colvin, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 981 days.

(21) Appl. No.: 12/754,799

(22) Filed: Apr. 6, 2010

(65) Prior Publication Data

US 2011/0241409 A1 Oct. 6, 2011

(51) Int. Cl.

| | |
|---|---|
| ***E21C 35/18*** | (2006.01) |
| ***E02F 9/28*** | (2006.01) |
| ***B28D 1/18*** | (2006.01) |
| ***E21C 35/183*** | (2006.01) |

(52) U.S. Cl.

CPC ..... *E02F 9/2866* (2013.01); *B28D 1/186* (2013.01); *E02F 9/2858* (2013.01); *E21C 35/18* (2013.01); *E21C 35/183* (2013.01)

(58) Field of Classification Search

USPC ..... 299/79.1, 101–111, 112 R, 112 T, 113

See application file for complete search history.

(56) References Cited

U.S. PATENT DOCUMENTS

| | | | | |
|---|---|---|---|---|
| 1,550,669 | A * | 8/1925 | Bowman | 299/83.1 |
| 1,903,772 | A * | 4/1933 | Bowman | 299/83.1 |
| 2,754,100 | A | 7/1956 | Cartlidge | |
| 3,361,481 | A | 1/1968 | Maddock | |
| 3,476,438 | A | 11/1969 | Bower, Jr. | |
| 3,746,396 | A | 7/1973 | Radd | |
| 3,801,158 | A | 4/1974 | Radd et al. | |
| 3,833,264 | A | 9/1974 | Elders | |
| 4,065,185 | A | 12/1977 | Elders | |
| 4,850,649 | A | 7/1989 | Beach et al. | |
| 5,141,289 | A | 8/1992 | Stiffler | |
| D347,232 | S | 5/1994 | Massa et al. | |
| 5,324,098 | A | 6/1994 | Massa et al. | |
| D387,072 | S | 12/1997 | Ojanen | |
| 6,019,434 | A | 2/2000 | Emmerich | |

(Continued)

FOREIGN PATENT DOCUMENTS

| | | |
|---|---|---|
| CN | 201007211 Y | 1/2008 |
| CN | 201218099 Y | 4/2009 |

(Continued)

OTHER PUBLICATIONS

China Office Action dated May 19, 2014 with attached China Search Report.

*Primary Examiner* — Sunil Singh
(74) *Attorney, Agent, or Firm* — Matthew S. Bedsole

(57) ABSTRACT

A rotatable cutting tool for use in impinging earth strata wherein the rotatable cutting tool comprises a cutting tool body and a hard tip affixed to the cutting tool body. The cutting tool body includes an axial forward end for receiving the hard tip and an axial rearward end, a head portion axially rearward of the axial forward end, a collar portion axially rearward of the head portion, and a shank portion axially rearward of the collar portion and axially forward of the axial rearward end. The head portion includes a plurality of elongated projections extending radially thereabout, each of the elongated projections including a first tapered side and a second tapered side. The first tapered side of each of the elongated projections adjoins the second tapered side of an adjacent elongated projection at a surface of the head portion.

14 Claims, 3 Drawing Sheets

(56) References Cited

U.S. PATENT DOCUMENTS

| | | | | |
|---|---|---|---|---|
| 6,341,823 | B1 | 1/2002 | Sollami | |
| 7,458,646 | B2 | 12/2008 | Marathe et al. | |
| 2009/0184564 | A1* | 7/2009 | Brady | 299/100 |

FOREIGN PATENT DOCUMENTS

| | | | |
|---|---|---|---|
| CN | 201232552 | Y | 5/2009 |
| CN | 101513706 | A | 8/2009 |
| CN | 201428456 | Y | 3/2010 |

* cited by examiner

ROTATABLE CUTTING TOOL WITH HEAD PORTION HAVING ELONGATED PROJECTIONS

BACKGROUND OF THE INVENTION

The invention pertains to a rotatable cutting tool that is useful for the impingement of earth strata such as, for example, asphaltic roadway material, coal deposits, mineral formations and the like. More specifically, the present invention pertains to a rotatable cutting tool that is useful for the impingement of earth strata wherein the cutting tool body possesses improved design so as to provide for improved performance characteristics for the rotatable cutting tool.

Rotatable cutting tools have been used to impinge earth strata such as, for example, asphaltic roadway material or ore bearing or coal bearing earth formations or the like. Generally speaking, these kinds of rotatable cutting tools have an elongate cutting tool body (typically made from steel) and a hard tip (or insert) affixed to the cutting tool body at the axial forward end thereof. The hard tip is typically made from a hard material such as, for example, cemented (cobalt) tungsten carbide. The rotatable cutting tool is rotatably retained or held in the bore of a tool holder or, in the alternative, in the bore of a sleeve that is in turn held in the bore of a holder.

The holder is affixed to a driven member such as, for example, a driven drum of a road planing machine. In some designs, the driven member (e.g., drum) carries hundreds of holders wherein each holder carries a rotatable cutting tool. Hence, the driven member may carry hundreds of rotatable cutting tools. The driven member is driven (e.g., rotated) such that the hard tip of each one of the rotatable cutting tools impinges or impacts the earth strata (e.g., asphaltic roadway material) thereby fracturing and breaking up the material into debris.

As can be appreciated, during operation the entire rotatable cutting tool is typically subjected to a variety of extreme cutting forces and stresses in an abrasive and erosive environment. Rotatable cutting tools having a cutting tool body with various shapes and designs have been provided to most efficiently and effectively operate in these extreme cutting environments. However, it would be undesirable for the cutting tool body to prematurely wear or fail (whether it be through catastrophic fracture or the like or through abrasive or erosive wear) prior to the hard cutting tip wearing to the point of its useful life. In such a circumstance, the rotatable cutting tool would have to be replaced prior to the normally scheduled time for replacement. Further, the premature failure of the rotatable cutting tool would negatively impact the cutting or milling efficiency of the overall earthworking apparatus. It thus becomes apparent that it is important and desirable that the cutting tool body possess the requisite design and strength to maintain its integrity during the intended useful life of the rotatable cutting tool while still providing an efficient and effective rotatable cutting tool.

SUMMARY OF THE INVENTION

An aspect of the present invention is to provide a rotatable cutting tool for use in impinging earth strata wherein the rotatable cutting tool comprises a cutting tool body and a hard tip affixed to the cutting tool body. The cutting tool body includes an axial forward end for receiving the hard tip and an axial rearward end, a head portion axially rearward of the axial forward end, a collar portion axially rearward of the head portion, and a shank portion axially rearward of the collar portion and axially forward of the axial rearward end. The head portion includes a plurality of elongated projections extending radially thereabout, each of the elongated projections including a first tapered side and a second tapered side. The first tapered side of each of the elongated projections adjoins the second tapered side of an adjacent elongated projection at a surface of the head portion.

A further aspect of the present invention is to provide a rotatable cutting tool body with a central longitudinal axis wherein the rotatable cutting tool body comprises a head portion, a shank portion, and a collar portion mediate of and contiguous with the head portion and shank portion. The cutting tool body further includes an axial forward end adjacent to the head portion and an axial rearward end adjacent to the shank portion. The head portion includes a plurality of elongated projections extending radially thereabout, each of the elongated projections comprising a first tapered side and a second tapered side, wherein the first tapered side of each of the elongated projections adjoins the second tapered side of an adjacent elongated projection at a surface of the head portion.

Another aspect of the present invention is to provide a rotatable cutting tool having a hard tip affixed thereto for use in impinging earth strata wherein the rotatable cutting tool comprises a head portion, a shank portion, and a collar portion mediate of and contiguous with the head portion and shank portion. The head portion includes a plurality of generally V-shaped longitudinal grooves extending from adjacent the collar portion to adjacent an axial forward end adjacent to the head portion.

These and other aspects of the present invention will be more fully understood following a review of this specification and drawings.

DETAILED DESCRIPTION

Figure 1:
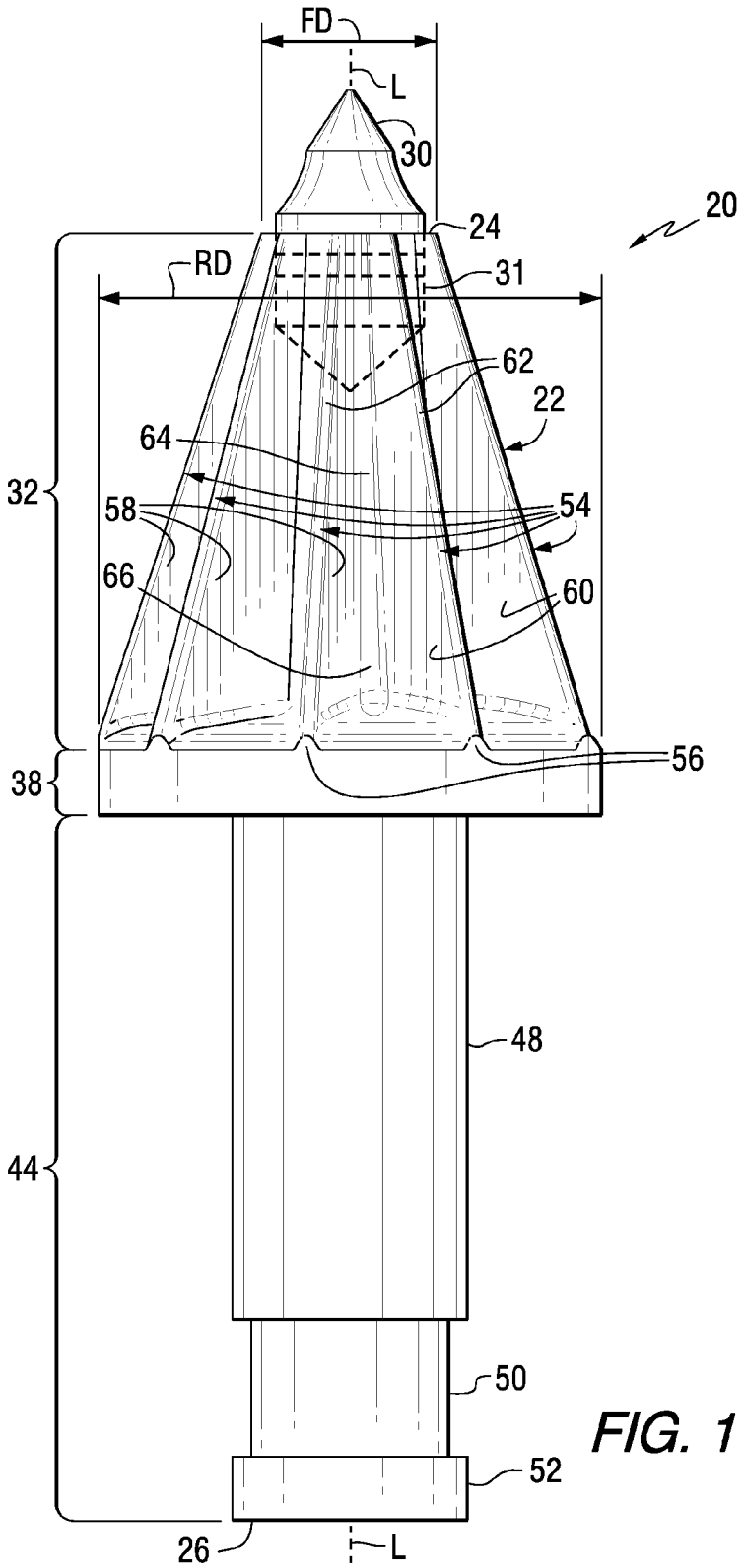
FIG. 1 illustrates a side view of a rotatable cutting tool, in accordance with an aspect of the invention.
Figure 2:
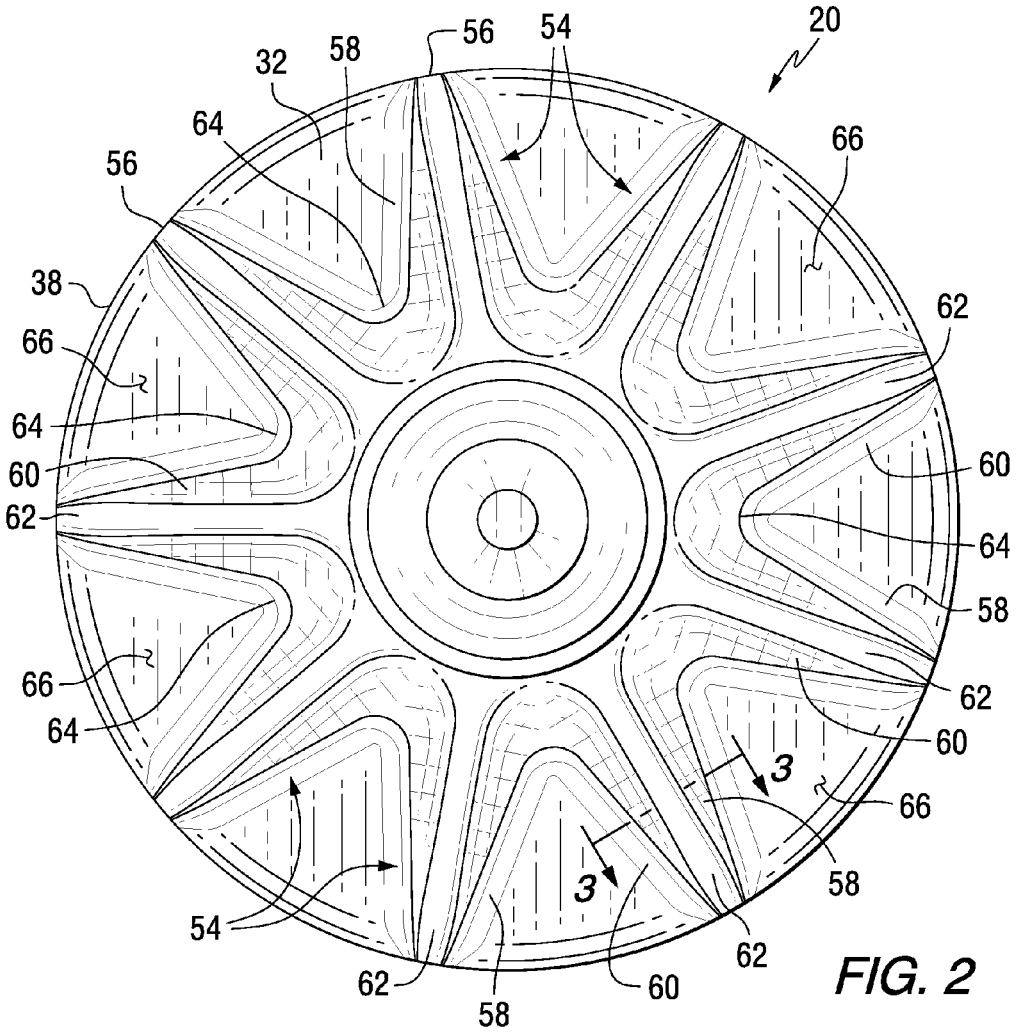
FIG. 2 illustrates a top view of the rotatable cutting tool shown in FIG. 1, in accordance with an aspect of the invention.

FIGS. 1 and 2 illustrate a rotatable cutting tool, generally designated as 20, in accordance with one aspect of the invention. Rotatable cutting tool 20 comprises an elongate cutting tool body, generally designated as 22. The cutting tool body 22 is typically made of steel such as those grades disclosed, for example, in U.S. Pat. No. 4,886,710 to Greenfield, which is hereby incorporated by reference.

Still referring to FIGS. 1 and 2, the cutting tool body 22 has an axial forward end 24 and an axial rearward end 26. A hard tip or insert 30 is affixed (such as by brazing or the like) in a socket 31 in the axial forward end 24 of the cutting tool body 22. Hard insert 30 is typically made from cemented carbide such as, for example, cemented (cobalt) tungsten carbide wherein U.S. Pat. No. 6,375,272, which is hereby incorporated by reference, to Ojanen discloses examples of acceptable grades of cemented (cobalt) tungsten carbide. The geometry of the hard insert 30 can vary depending upon the specific application. U.S. Pat. No.

6,375,272 to Ojanen discloses an exemplary geometry for the hard insert. It should be appreciated that as an alternative to the socket, the axial forward end of the cutting tool body may present a projection that is received within a socket in the bottom of the hard tip. This alternate structure can be along the lines of that disclosed, for example, in U.S. Pat. No. 5,141,289 to Stiffler, which is hereby incorporated by reference.

The cutting tool body 22 is divided into three principal portions; namely, a head portion, a collar portion and a shank portion. The most axial forward portion is a head portion (see bracket 32). The head portion 32 begins at the axial forward end 24 and extends along longitudinal axis L-L in the axial rearward direction.

The mediate portion is the collar portion (see bracket 38). The collar portion 38 begins at the juncture with the head portion 32 and extends along the longitudinal axis L-L in the axial rearward direction.

The most axial rearward portion is the shank portion (see bracket 44). Beginning at the juncture with the collar portion 38 and extending along the longitudinal axis L-L in the axial rearward direction, the shank portion 44 comprises a forward cylindrical tail section 48, followed by a retainer groove 50, and terminating in a rearward cylindrical tail section 52. As is known by those skilled in the art, the shank portion 44 is the portion of the cutting tool body 22 that carries the retainer (not illustrated). The retainer rotatably retains the rotatable cutting tool in the bore of a tool holder (not illustrated) or the bore of the sleeve carried by a holder. While the retainer can take on any one of many geometries, a retainer suitable for use with this cutting tool body is shown and described, for example, in U.S. Pat. No. 4,850,649 to Beach et al., which is hereby incorporated by reference.

As illustrated in FIGS. 1 and 2, the head portion 32 includes a plurality of elongated projections, generally designated by 54, that extend radially about the head portion 32. Each of the elongated projections 54 can extend from adjacent the collar portion 38 to adjacent the axial forward end 24 of the cutting tool body 22. In one aspect, the projections 54 extend in a generally linear or straight manner from adjacent the collar portion 38 to adjacent the axial forward end 24 of the cutting tool body 22. In addition, an axial rearward portion 56 of each of the elongated projections 54 can be radially coextensive with the collar portion 38. It will be understood that while the rotatable cutting tool 20 shown in FIGS. 1 and 2 has nine elongated projections 54 spaced radially about the head portion 32 that the number of projections can vary (see, for example, FIG. 4) and that the number of projections may be, for example, from about five projections to about fifteen projections as may be appropriate for a particular use of the rotatable cutting tool. It will be appreciated that an increased number of projections enhances the overall strength and/or provides for more wear protection of the cutting tool body 22 thus extending its life.

Figure 3:
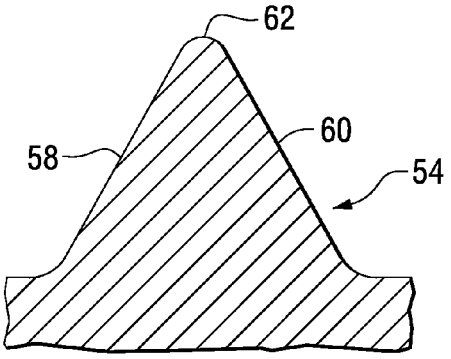
FIG. 3 is a cross-sectional view taken along line 3-3 of FIG. 2, in accordance with an aspect of the invention.

Referring to FIGS. 1, 2 and 3, each of the elongated projections 54 include a first tapered side 58 and a second tapered side 60. Each projection 54 further includes an apex 62 culminating between the first tapered side 58 and the second tapered side 60. The configuration of the first tapered side 58, the second tapered side 60, and the apex 62 results in the elongated projections having a generally triangular cross-sectional shape (see FIG. 3 cross-sectional view), but it will be understood that the elongated projections may have various other cross-sectional shapes as well in accordance with the invention. In one aspect, the apex 62 of the projections 54 extend in a generally linear or straight manner from adjacent the collar portion 38 to adjacent the axial forward end 24 of the cutting tool body 22.

Referring to FIGS. 1 and 2, the first tapered side 58 of each elongated projection 54 adjoins the second tapered side 60 of an adjacent elongated projection 54 at a surface 64 of the head portion 32. Thus, adjacent elongated projections 54 are connected or contiguous at the surface 64. This configuration results in a plurality of generally V-shaped longitudinal grooves 66 being formed between adjacent elongated projections 54, but it will be understood that the longitudinal grooves may have various other shapes as well in accordance with the invention. In one aspect, the longitudinal grooves 66 extend from adjacent the collar portion 38 to adjacent the axial forward end 24 of the cutting tool body 22.

The longitudinal grooves 66 are formed by, for example, forged cold or warm cast metal or powdered metal.

As shown in FIG. 1, the head portion 32 includes an axial forward diameter FD adjacent the axial forward end 24 of the cutting tool body 22 and an axial rearward diameter RD adjacent the collar portion 38. In one aspect, the apex 62 of each of the elongated projections 54 slopes from the axial rearward diameter RD toward the axial forward diameter FD. In another aspect, the apex 62 of each of the elongated projections 54 slopes at a uniform linear rate from the axial rearward diameter RD to the axial forward diameter FD.

Figure 4:
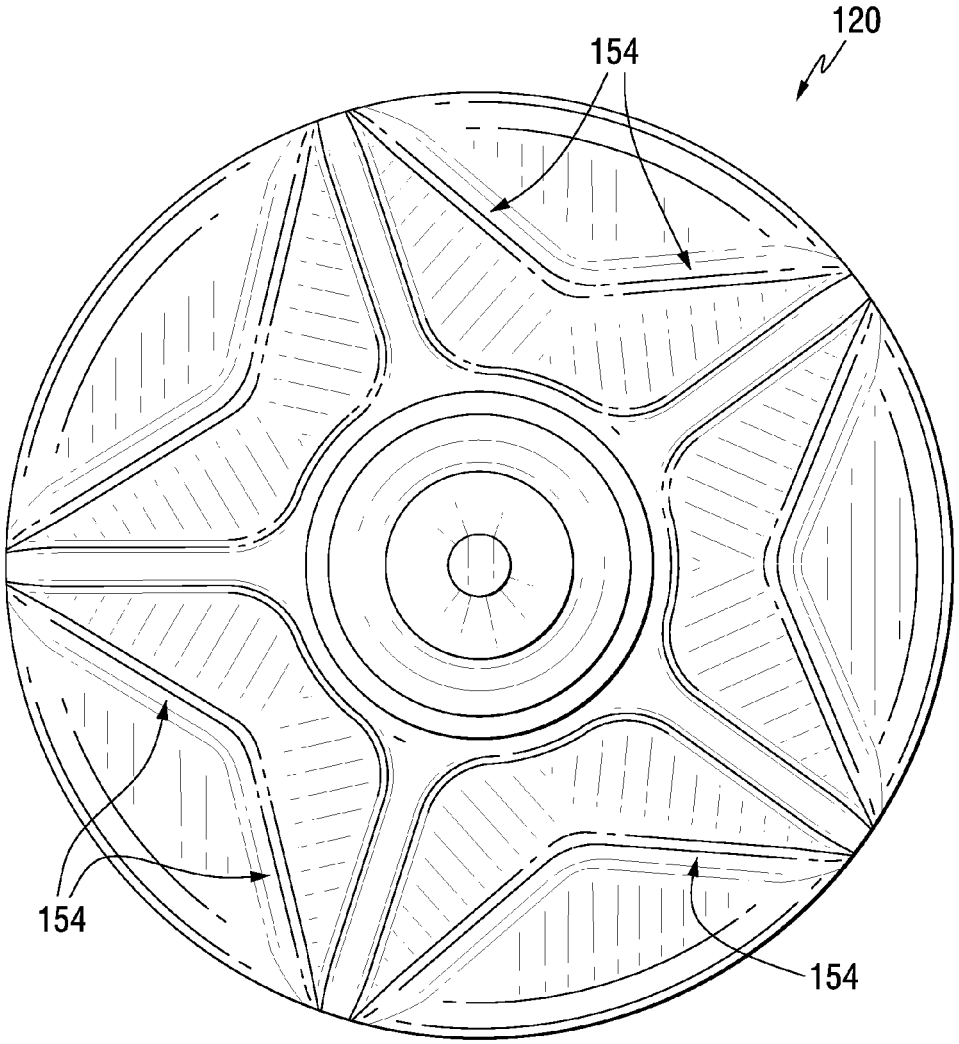
FIG. 4 illustrates a top view of an additional rotatable cutting tool, in accordance with another aspect of the invention.

FIG. 4 illustrates a top view of an additional rotatable cutting tool 120, in accordance with an aspect of the invention. The tool 120 is similar to the tool 20 described and illustrated herein, except that the tool 120 has only five elongated projections 154 spaced radially thereabout.

In accordance with another aspect of the invention, each of the elongated projections 54 can be hardened for increased strength and may have, for example, a hardness in the range of about 40 hrc to about 80 hrc. In one aspect, the apex 62 of each projection 54 can be hardened to a desired depth through a process of case hardening, or controlling the depth of induction heat treatment. This allows the apex 62 to be harder than the core which results in better wear resistance and in turn better life while maintaining strength through the core of the tool 20.

In accordance with aspects of the invention, it will be appreciated that the design of the cutting tool 20 is tapered toward the tip 30 while the elongated projections 54 slim down the profile and surface size of the head portion 32. This allows the tool 20 to have better penetration while maintaining overall strength. In another aspect, it will be appreciated that the design of the tool 20 allows for material, e.g. earth strata being cut to accumulate or pack in between the elongated projections 54 so as to serve as a wear protector this reducing wear on the tool 20.

Whereas particular embodiments of this invention have been described above for purposes of illustration, it will be evident to those skilled in the art that numerous variations of the details of the present invention may be made without departing from the invention as defined in the appended claims.

What is claimed is:

1. A rotatable cutting tool for use in impinging earth strata, the rotatable cutting tool comprising:

a cutting tool body;

a hard tip affixed to the cutting tool body;

the cutting tool body having an axial forward end for receiving the hard tip and an axial rearward end, a head portion axially rearward of the axial forward end, a collar portion axially rearward of the head portion, and a shank portion axially rearward of the collar portion; and wherein the head portion includes a plurality of elongated projections extending radially thereabout, each of the elongated projections including a first tapered side, a second tapered side and an apex culminating between the first tapered side and the second tapered side, wherein the first tapered side of each of the elongated projections is contiguous with the second tapered side of an adjacent elongated projection at a surface such that the first tapered side is contiguous with the second tapered side at said surface from adjacent the collar portion to adjacent the axial forward end of the cutting tool body to form a plurality of longitudinal grooves extending from adjacent the collar portion to adjacent the axial forward end of the cutting tool body.

2. The rotatable cutting tool of claim 1, wherein each of the elongated projections extends from adjacent the collar portion to adjacent the axial forward end of the cutting tool body.

3. The rotatable cutting tool of claim 1, wherein the head portion includes an axial forward diameter adjacent the axial forward end of the cutting tool body and an axial rearward diameter adjacent the collar portion, wherein the apex of each of the elongated projections slopes from the axial rearward diameter toward the axial forward diameter.

4. The rotatable cutting tool of claim 3, wherein the apex of each of the elongated projections slopes at a uniform linear rate from the axial rearward diameter to the axial forward diameter.

5. The rotatable cutting tool of claim 1, wherein an axial rearward portion of each of the elongated projections is radially coextensive with the collar portion.

6. The rotatable cutting tool of claim 1, wherein the apex of each of the elongated projections has a hardness in the range of about 40 hrc to about 80 hrc.

7. The rotatable cutting tool of claim 1, wherein each of the elongated projections includes a generally triangular cross-sectional shape.

8. A rotatable cutting tool body with a central longitudinal axis, the rotatable cutting tool body comprising:

a head portion, a shank portion, and a collar portion mediate of and contiguous with the head portion and the shank portion;

an axial forward end adjacent to the head portion and an axial rearward end adjacent to the shank portion;

wherein the head portion includes a plurality of elongated projections extending radially thereabout, each of the elongated projections including a first tapered side, a second tapered side and an apex culminating between the first tapered side and the second tapered side, wherein the first tapered side of each of the elongated projections is contiguous with the second tapered side of an adjacent elongated projection at a surface such that the first tapered side is contiguous with the second tapered side at said surface from adjacent the collar portion to adjacent the axial forward end adjacent to the head portion to form a plurality of longitudinal grooves extending from adjacent the collar portion to adjacent the axial forward end adjacent to the head portion.

9. The rotatable cutting tool body of claim 8, wherein each of the elongated projections extends from adjacent the collar portion to adjacent the axial forward end adjacent to the head portion.

10. The rotatable cutting tool body of claim 8, wherein the head portion includes an axial forward diameter adjacent the axial forward end adjacent to the head portion and an axial rearward diameter adjacent the collar portion, wherein the apex of each of the elongated projections slopes from the axial rearward diameter to the axial forward diameter.

11. The rotatable cutting tool body of claim 10, wherein the apex of each of the elongated projections slopes at a uniform linear rate from the axial rearward diameter to the axial forward diameter.

12. The rotatable cutting tool body of claim 8, wherein an axial rearward portion of each of the elongated projections is radially coextensive with the collar portion.

13. The rotatable cutting tool body of claim 8, wherein the apex of each of the elongated projections has a hardness in the range of about 40 hrc to about 80 hrc.

14. The rotatable cutting tool body of claim 8, wherein each of the elongated projections includes a generally triangular cross-sectional shape.

* * * * *